US005502545A

United States Patent [19]

Tsuruoka

[11] Patent Number: 5,502,545

[45] Date of Patent: Mar. 26, 1996

[54] JAM PROCESSING DEVICE SUITABLE FOR USE IN AN IMAGE FORMING APPARATUS

[75] Inventor: Ryoichi Tsuruoka, Ebina, Japan

[73] Assignee: Fuji Xerox Co., Ltd., Tokyo, Japan

[21] Appl. No.: 417,038

[22] Filed: Apr. 5, 1995

[30] Foreign Application Priority Data

May 16, 1994 [JP] Japan ..... 6-125720

[51] Int. Cl.[6] ..... G03G 15/00

[52] U.S. Cl. ..... 355/207; 355/316

[58] Field of Search ..... 355/208, 207, 355/206, 308, 309, 316, 326, 327

[56] References Cited

U.S. PATENT DOCUMENTS 4,873,541 10/1989 Hirose et al. ..... 355/326 R X
4,888,621 12/1989 Ohno ..... 355/326 R

FOREIGN PATENT DOCUMENTS 59-155870 9/1984 Japan .
63-8665 1/1988 Japan .
1-96670 4/1989 Japan .
2-257158 10/1990 Japan .

*Primary Examiner*—Joan H. Pendegrass
*Assistant Examiner*—Quana Grainger
*Attorney, Agent, or Firm*—Oliff & Berridge

[57] ABSTRACT

A jam processing device comprising a plurality of paper jam detectors positioned in a paper conveying path, a device for forcedly ejecting the jammed paper and a device for selectively controlling actuation of respective components in an image forming apparatus. The jam processing device is suitable for use in an image forming apparatus that holds a sheet of paper on a transfer belt and transfers toner images from a plurality of photosensitive drums to the paper. When a paper jam is developed in the paper conveying path, a mode for forcedly ejecting the paper is initiated to charge and destaticize the transfer belt. Further, the paper is fed and ejected from the paper conveying path while each photosensitive drum is being charged and destaticized.

3 Claims, 5 Drawing Sheets

JAM PROCESSING DEVICE SUITABLE FOR USE IN AN IMAGE FORMING APPARATUS

BACKGROUND OF THE INVENTION

1. Field of the Invention

The present invention relates to an image forming apparatus of a type wherein a belt-like recording paper carrying member is allowed to electrostatically absorb a sheet of recording paper such as paper and hold it thereon and toner images are successively superimposed on and transferred to the recording paper while the recording paper is being fed along an image transfer unit comprising a plurality of photoconductive or photosensitive drums, and particularly, to a device wherein when a paper jam is developed in the recording paper carrying member and at a back-and-front position of the recording paper carrying member, a means for forcedly ejecting the recording paper located in the neighborhood of the recording paper carrying member is provided to thereby make it possible to facilitate the operation for ejecting the recording paper.

2. Description of the Related Art

As an image forming apparatus such as an electrophotographic copier capable of making a color copy or a laser beam printer, an apparatus of a type which has been disclosed in Japanese Patent Laid-Open No. Sho 59(1984)-155870, for example, is known. In the conventional color electrophotographic copier, a plurality of image carriers such as photosensitive drums for forming color toner images based on information obtained by separating images on the original for every color are provided. Further, an image transfer unit comprising the photosensitive drums is disposed along a recording paper carrying member. This type of copier forms an apparatus of a type wherein while a sheet of paper used as recording paper is being fed in a state in which the paper is being electrostatically carried by a belt-like recording paper carrying member, color toner images from photosensitive drums are successively superposed on and transferred to the paper carried by the recording paper carrying member, is constructed. In the aforementioned apparatus, since the toner images are successively superimposed on and transferred to the paper, the weight of toner carried by the recording paper becomes large, thereby making it possible to have the recording paper and the recording paper carrying member carry the performance for holding large transfer charges in correspondence with the weight of toner.

The apparatus for causing the recording paper carrying member to electrostatically absorb and hold the recording paper as described above needs a means for separating the recording paper from the recording paper carrying member after the color toner images have been transferred to the paper and feeding it to the fixing device. Therefore, a normal image forming apparatus using a recording paper carrying member is used in which a small-diameter roller member is provided at the position where a sheet of recording paper is separated and the function of reducing an electrostatic absorbing force using a means for separating the recording paper owing to an abrupt bend of the recording paper carrying member and a discharger or the like is applied thereto. Further, a method of disposing a separation claw member in a recording paper separation unit incidentally to the above-described separating means, causing the leading end portion of the separation claw member to approach the surface of a recording paper carrying member and separating the recording paper using a guide means based on the separation claw member is used, for example.

In the image forming apparatus, a charging corotron for electrostatically absorbing or sucking and holding the recording paper by the recording paper carrying member, a transfer corotron for transferring a toner image from an image carrier, a separation corotron provided at the position where the recording paper is separated from the recording paper carrying member, a belt destaticizing corotron for removing the charging of the recording paper carrying member after the recording paper has been separated from the recording paper carrying member, etc., are provided along a paper conveying path formed by the recording paper carrying member. By providing the aforementioned corotrons, the image forming apparatus can charge and destaticize the recording paper carrying member and the recording paper. Further, the image forming apparatus performs a function or action for holding the recording paper on the recording paper carrying member, a function or action for separating the recording paper from the recording paper carrying member and a function for transferring the toner image from the image carrier to the recording paper.

In the aforementioned image forming apparatus, there is a case in which a plurality of image forming units are not used depending on the type of color toner image transferred to the recording paper. There are cases where copies are made using, for example, a black monochrome mode and red, blue and yellow monochrome modes or the two of the four colors and the three of the four colors. When the copy mode is set, the image forming apparatus takes the following measures against a toner-image forming image carrier and a toner-image unforming image carrier in order to prevent an omission of the image.

An image forming apparatus described in Japanese Patent Laid-Open No. Hei 1(1989)-96670 is disclosing a means for applying bias to all-color development rollers regardless of the color mode when a two-component developer is employed in a developer unit to thereby prevent carriers of the two-component developer and needless toner from adhering to the image carrier. On the other hand, in a state in which the polarity of the toner electrostatically carried or supported by the recording paper and a charge characteristic of the image carrier are different from each other, when the recording paper passes through the position of the toner-image unforming image carrier, a problem arises that the toner carried by the recording paper is transferred to the image carrier to thereby cause reverse transfer, whereby the image is deteriorated. In order to solve the aforementioned problem, a means for activating a charging means of a toner-image unforming image carrier and an image transfer means to thereby prevent the reverse transfer from being brought to the image carrier has been proposed in an image forming apparatus disclosed in Japanese Patent Laid-Open No. Sho 63(1988)-8665.

However, the image forming apparatus of a type wherein the plurality of image carriers are provided so as to successively superimpose the color toner images on and transfer them to the recording paper (hereinafter called "paper"), is disclosing the means for preventing imperfections in the image transferred to the paper in the course of transfer of the normal color toner image to the paper, but does not take into consideration countermeasures to be taken when a paper jam (jammed paper) or the like takes place. In the conventional image forming apparatus, an operation for processing jammed paper after the jammed paper has been detected, e.g., a method of forcedly ejecting the paper has not been taken into consideration.

Thus, as means for solving the above problems, an apparatus disclosed in Japanese Patent Laid-Open No. Hei 2(1990)-257158, for example, may be constructed as one method. The above-described conventional example shows a paper feeder constructed in such a manner that when a paper jam is developed within a reverse conveying path provided on the downstream side of a fixing device, a sheet of paper extending on a recording paper carrying member can be automatically ejected from an ejection path divided from the position on this side of the paper. However, the aforementioned image forming apparatus has a problem that it is necessary to provide a special tray or the like to accommodate paper ejected in the course of its delivery therein, thereby making the image forming apparatus complex in structure.

The normal image forming apparatus is provided with a function for indicating, based on a self-diagnosis function added to the body thereof, to which position on the paper conveying path the paper remains after the jammed paper has been detected. Further, a means is provided for setting a forced ejection mode for automatically ejecting the paper left in the paper conveying path after the paper has been removed by an operator. Particularly, in a color image forming apparatus of a type wherein four image carriers are arranged along a paper conveying path formed by a recording paper carrying member so as to obtain full-color images of four colors, the number of papers simultaneously carried by the recording paper carrying member inevitably increases. Therefore, the setting of a mode for automatically performing an operation for forcedly ejecting paper simultaneously fed within the paper conveying path is indispensable.

When it is desired to set the mode for forcedly ejecting the paper carried by the recording paper carrying member as described above, a control information mode for deactivating a charging corotron for causing the recording paper carrying member to electrostatically absorb a sheet of paper ejected as a miss copy in blank paper and a separation corotron for peeling or separating the paper from the recording paper carrying member is often used. However, when the control information mode is set, each image carrier is charged by a charging means. When a transfer corotron is in a deactivated state, there is a case where the feeding of the paper to the recording paper carrying member alone cannot make a conveying operation in a state in which the paper is being held by the recording paper carrying member. When the paper is separated from the recording paper carrying member and is attracted by the image carrier, the paper plunges into a cleaning device, thereby causing inconvenience that a new paper jam is developed. The aforementioned phenomenon tends to greatly occur in the image carrier located upstream of a traveling path of the recording paper carrying member in particular.

On the other hand, when the transfer corotron provided so as to correspond to the image carrier is activated, the frequency of occurrence of inconvenience that the paper is wound around the image carrier if the charging corotron for attracting the paper to the recording paper carrying member is in a deactivated state, is less reduced but is completely unavoidable. When the separation corotron for separating the paper from the recording paper carrying member is deactivated regardless of the actuation of the transfer corotron associated with the image carrier, a problem arises that the mistake of separation of the paper from the recording paper carrying member is made, so that the paper plunges into other device located on the downstream side of the separation unit.

SUMMARY OF THE INVENTION

It is an object of the present invention to solve problems such as a paper jam developed in a paper feeder employed in an image forming apparatus used as a conventional recording paper carrying member and to provide a jam processing device suitable for use in an image forming apparatus, which is capable of preventing the occurrence of a mistake of separation of a sheet of jammed paper from the recording paper carrying member and the winding of the paper around each of image carriers when a sheet of paper fed subsequent to the jammed paper is forcedly ejected and of satisfactorily carrying out an operation for forcedly ejecting the paper.

According to one aspect of the present invention, for achieving the above object, there is provided a jam processing device suitable for use in an image forming apparatus, comprising: one or a plurality of image carriers disposed so as to form a paper conveying path along a path for feeding a sheet of recording paper by means for electrostatically carrying the recording paper; means for writing image information into the image carrier(s) so as to form toner images; means for transferring the toner images to the recording paper; and means for separating the recording paper from an end of the recording paper carrying means and feeding the same to a fixing device, the jam processing device comprising: a plurality of detecting means for detecting paper jams developed in the paper conveying path; control means for forcedly ejecting the recording paper existing in the paper conveying path in accordance with information about the paper jams detected by the detecting means; and means for arbitrarily selecting and controlling actuation and non-actuation of the respective means included in the image forming apparatus acting on the image carrier(s), the recording paper and the recording paper carrying means, based on the information about the paper jams detected by the detecting means when the recording paper is forcedly ejected from the paper conveying path.

According to the present invention as well, when it is judged, based on the information, that it is difficult to continue to normally form images on the recording paper left within the paper conveying path upon forcedly ejecting the recording paper, only charging and destaticizing means provided so as to correspond to the recording paper carrying means can be actuated. Further, according to the present invention, when it is judged, based on the information, that it is able to continue to normally form the images on the recording paper left within the paper conveying path upon forcedly ejecting the recording paper, an operation for ejecting the recording paper can be continuously effected while a normal image-forming operation remains continued and a means for performing control for unfeeding new recording paper to the paper conveying path can be provided.

In the image forming apparatus constructed as described above, an electrostatically absorbing transfer belt is used as the recording paper carrying means. The plurality of detecting means for sensing the paper jams developed in the paper conveying path formed by the recording paper carrying means are provided. When the paper jam developed in the paper conveying path is detected, the mode for forcedly ejecting the paper is set in such a manner that the recording paper left in the paper conveying path can be forcedly ejected. If it is determined that the transfer of the toner image from each image carrier cannot be continuously carried out when the recording paper in the paper conveying path is forcedly ejected, then only the corotrons for charging and destaticizing the transfer belt are actuated and only the operation for feeding and ejecting the recording paper is continuously performed. When it is judged-based on the state of occurrence of the detected jam that the transfer of the toner image to the recording paper can be continuously carried out, a normal copy producing operation is continuously effected on the recording paper while being in the course of its feeding and a copy created through the fixing device is ejected. Thus, when it is possible to normally make a copy with respect to the recording paper left in the paper conveying path corresponding to the image transfer position when the paper jam takes place, recording paper to be abandoned can be prevented from being excessively supplied.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
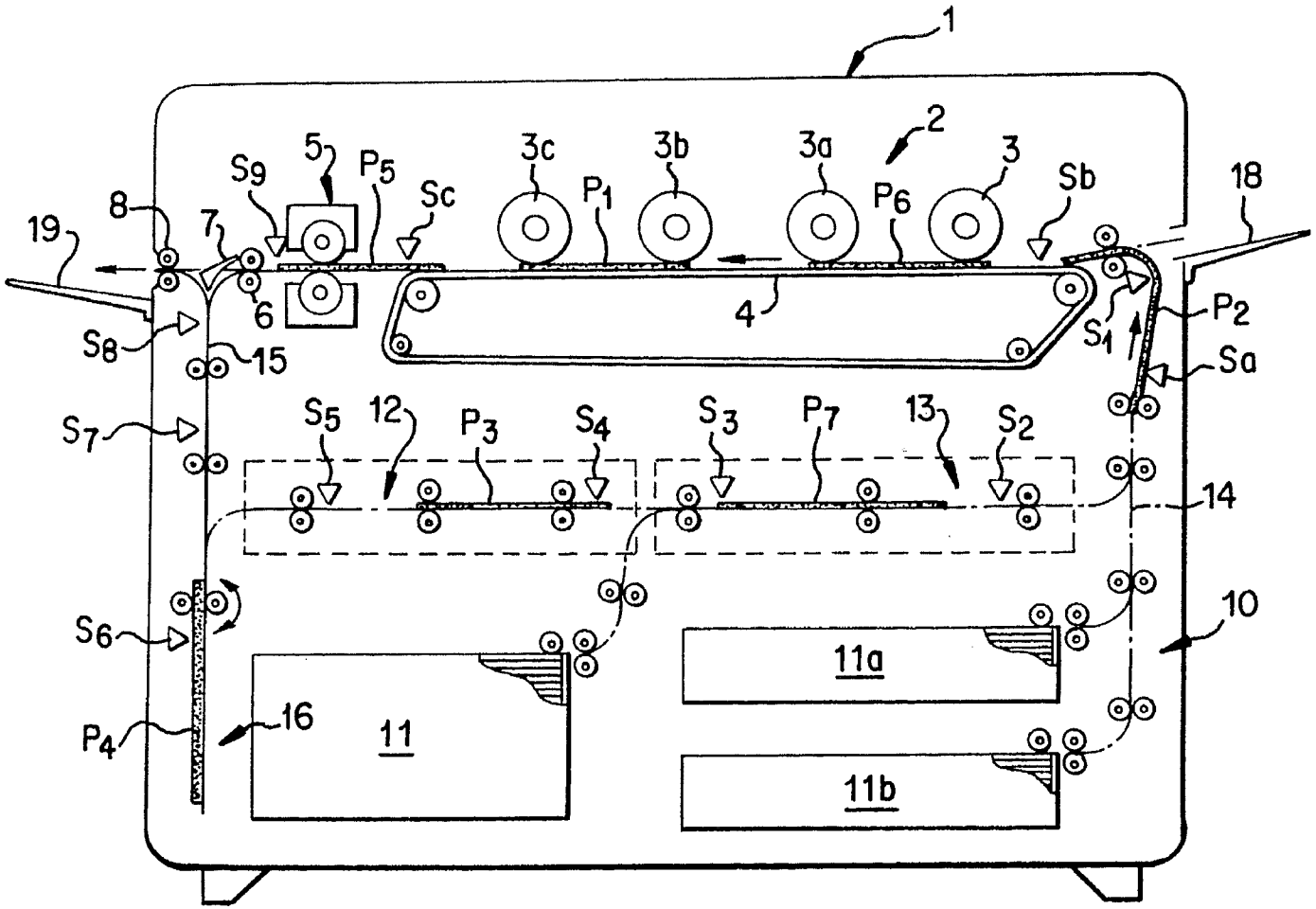
FIG. 1 is a view for describing the structure of an image forming apparatus according to the present invention.

A preferred jam processing device employed in an image forming apparatus according to the present invention will hereinafter be described by way of illustrative example. FIG. 1 shows the structure of an image forming apparatus 1 constructed as an automatic duplex copier according to the present invention. The illustrated embodiment is constructed as a full-color copier in which four photosensitive drums 3, 3*a*, 3*b* and 3*c* serving as image carriers are respectively disposed in an image transfer unit 2 of the image forming apparatus 1. The photosensitive drums 3, 3*a*, 3*b* and 3*c* disposed in the image transfer unit 2 are respectively provided with writing means for forming images different in color from each other, toner image producing mechanisms, etc., and form a mechanism for separating image information sent from an image formation output device such a computer or the like for every color, producing color toner images with respect to the photosensitive drums and transferring the same onto a sheet of recording paper (hereinafter called "paper"). A transfer belt 4 in the image transfer unit 2, which serves as a paper carrying member for feeding the paper, is provided with means for holding the paper on the surface of the transfer belt under the action of static electricity and forms means for preventing displacements or the like from being developed in the image transfer position when the color toner images formed on the respective photosensitive drums are successively superposed on and transferred to the paper while the paper is being fed along a paper conveying path.

A paper feeding unit 10 in the image forming apparatus 1 is provided with a plurality of paper feeding trays 11, 11*a*, . . . and is capable of feeding out a sheet of paper of specified size from sheets of paper accommodated in the paper feeding trays. Further, the paper fed out form the corresponding paper feeding tray is conveyed along a paper feeding path 14 so as to be fed to the transfer belt 4 disposed so as to correspond to the image transfer unit 2 in a state registered by a register roller device. Next, the toner images are transferred onto the paper while the paper is being fed, and are thereafter fixed by a fixing device 5. The so-processed paper is ejected toward an ejection tray 19 by a conveying roller device 6 and an ejection roller device 8. In the device of the present invention, a desired ejection mode for reversely ejecting a sheet of paper created as a one-side copy through a reverse means provided in a paper ejection path or directly ejecting it, for example, can be selected. In the aforementioned device, a reverse conveying path used for making a duplex copy includes a reverse path 15 and a both-side or duplex inverter 16 provided with a switching gate device 7 serving as a conveying-path switching member disposed between the roller devices 6 and 8 interposed therebetween, and a duplex copy conveying-path member 12 provided between the aforementioned two conveying paths through a branch means. A matching or registration conveying unit 13, which doubles as a path for feeding the paper from the paper feeding tray 11, is provided downstream of the duplex copy conveying-path member 12 so as to be connected to a path 14 for feeding the paper from other trays.

Further, a roller device capable of feeding the paper in forward and reverse directions with respect to the reverse conveying path is provided in the duplex inverter 16 provided in the reverse conveying path. The duplex inverter 16 has a function for firstly accommodating the paper fed from the reverse path 15 in the duplex inverter 16 and then delivering it to the duplex copy conveying-path member 12. The duplex copy conveying-path member 12 is provided with means for guiding the paper from a portion connecting the reverse path 15 and the duplex inverter 16 to each other through the switching gate device 7, so as to make it possible to feed out a sheet of one-side copying paper in a reverse state. Further, the registration conveying unit 13 disposed between the duplex copy conveying-path member 12 and the paper feeding path 14 is used to form the paper feeding path extending from the paper feeding tray 11. However, the registration conveying unit 13 also provides a function or action for registering the paper with a skew and the like developed therein while the paper is being fed within the reverse conveying path, as well as a function of forming the path. For example, the registration conveying unit 13 moves the paper along one of registration wall members in a paper path and applies a registration action to the paper to thereby make it able to feed out the paper to the paper feeding path 14. Thus, a burden developed when the registration action is applied to the one-side copying paper on the upstream side of the image transfer unit 2, can be reduced by providing matching or registration means inside the reverse conveying path.

In the paper conveying path formed in the above-described manner, a sheet of paper P1 with an image transferred onto a second surface thereof and a sheet of paper P6 with an image transferred onto a first surface thereof are located in the image transfer unit 2. Further, a sheet of paper P2 corresponding to the transfer of the image onto the second surface is located in the paper feeding path 14. A sheet of paper P5 with an image formed on a first surface thereof is in a fixed state by the fixing device 5. Further, a sheet of one-side copying paper P4, a sheet of reversed one-side copying paper P3 and a sheet of paper P7 newly fed from the paper feeding tray 11 are respectively disposed in the duplex inverter 16, the duplex copy conveying-path member 12 and the registration conveying unit 13. By using a control system for feeding the paper from a section on the upstream side, based on information about the passage of the paper, which is detected by any of sensors S1 through Sn disposed in respective conveying sections, front and back intervals of the paper are narrowed to thereby perform a paper conveying operation.

In the reverse conveying path, the paper is fed in a state in which the paper fed from the corresponding paper feeding tray is interposed between the one-side copying papers. The image transfer unit 2 is constructed in such a manner that both operations for transferring the image onto the first surface of the paper and transferring the image onto the second surface thereof can be successively repeated. The paper with the image transferred to the second surface passes through the fixing device 5 so as to be ejected toward the ejection tray 19. The paper having the first surface with the image transferred thereon and is made as a sheet of one-side copying paper, is fed to the reverse path 15 through the switching gate device 7 and is conveyed from the duplex inverter 16 to the duplex copy conveying-path member 12 in a reversed state.

When a normal one-side copying mode is set in the image forming apparatus, the paper fed from the corresponding paper feeding tray is fed from the paper feeding path 14 through the image transfer unit 2. After the paper has been fixed by the fixing device 5, it is fed out toward the ejection tray 19. When the one-side copying paper is ejected toward the ejection tray, a mode for ejecting the paper toward the ejection tray can also be selected after the paper has been reversed by the reverse path 15. Further, when it is desired to make copies using specific paper or the like unable to be held in the paper feeding trays or some sheets of paper, the paper can be inserted from a manual tray 18. This is performed by the operation similar to that executed by the conventional normal image forming apparatus.

Figure 2:
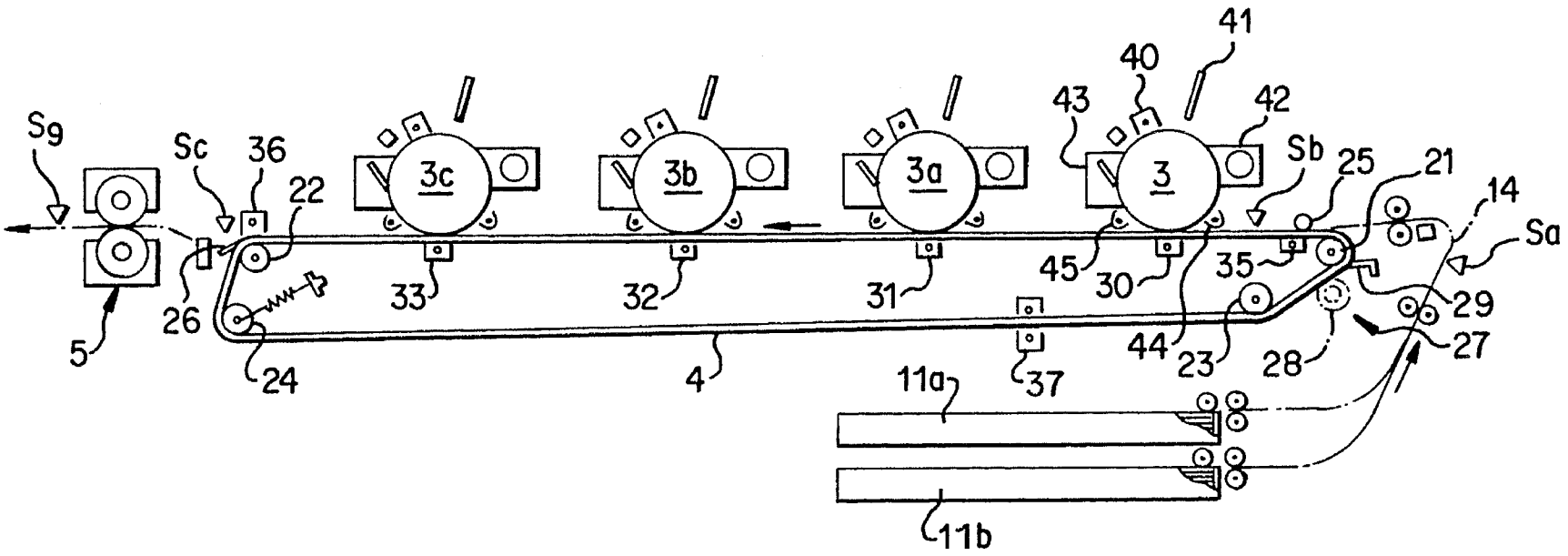
FIG. 2 is a view for describing the structure of a jam processing device according to the present invention, which is provided so as to correspond to a transfer belt.

In the image forming apparatus constructed as described above, the transfer belt 4 for feeding the paper along the image transfer unit 2 comprising the photosensitive drums, which serves as a recording-paper carrying member, is constructed as shown in FIG. 2. According to the embodiment illustrated in FIG. 2, the transfer belt 4 is disposed in a driver 20 for driving the transfer belt 4 in a state of being wound around roller members 21 through 24. The upper surface of the transfer belt 4 supported by the roller members 21 through 24 is used for the feeding of each paper. Further, a means for applying a tensile force to the roller member 24 is provided and one of the other roller members is formed as a drive roller and is connected with a means for transferring a driving force supplied from a drive motor. Each of the photosensitive drums 3, 3*a*, . . . disposed in the region for conveying the paper by the transfer belt 4, is provided with a means for forming a toner image in a manner similar to the image forming apparatus using a normal electrophotographic process.

As the means for forming the toner images on their corresponding photosensitive drums, a charging corotron 40 serving as a process device, a writing means 41, a developer unit 42, a destaticizing lamp 44, a cleaning device 43, a destaticizing corotron 45, etc., are provided as shown in the photosensitive drum 3. After uniform charging has been performed by the charging corotron 40, light indicative of image information separated for every color is transferred from an unillustrated image information output means to the surface of the photosensitive drum 3 through the writing means 41 so as to form an electrostatic latent image. Further, toner is supplied to the electrostatic latent image from the developer unit 42, so that the latent image is made visible as a toner image. Thereafter, the toner image is irradiated with light emitted from the destaticizing lamp 44 to make an adhesive force weak, followed by the transfer to the corresponding paper by discharging a transfer corotron 30. After the toner image has been transferred to the paper, toner left on the surface of the photosensitive drum is removed by the cleaning device 43. Further, light emitted from the destaticizing corotron 45 is applied to the surface of the photosensitive drum so as to set a residual potential to zero. Thereafter, the uniform charging is performed anew by the charging corotron 40.

In the embodiment illustrated in FIG. 2, transfer corotrons 30, 31, . . . are respectively provided on the reverse side of the transfer belt 4 so as to correspond to the photosensitive drums 3, 3*a*, . . . , and are respectively provided with means for transferring color toner images formed on the photosensitive drums to the corresponding paper by the discharging of the transfer corotrons. Further, an adhering portion for allowing the paper to electrostatically adhere to the transfer belt 4 and holding the same thereon is provided at one of the ends of the paper feeder. A press roller 25 for pressing the paper against the transfer belt 4 is provided downstream (with respect to the direction of movement of the transfer belt 4) of the roller member 21 supporting the transfer belt 4 thereon. Further, a charging corotron 35 is disposed on the reverse side of the transfer belt 4 so as to correspond to the press roller 25, thereby allowing the transfer belt 4 to perform a charging operation.

In addition to the devices corresponding to the paper conveying path, a cleaning device 27, which is a combination of a cleaning brush 28 and a blade 29, is provided upstream of the roller member 21 so as to form a means for eliminating smudges adhering to the surface of the transfer belt 4. A pair of transfer-belt destaticizing corotrons 37 for destaticizing the transfer belt is provided upstream of the cleaning device 27 so as to form a means for removing the previously-applied charges at a previous stage in allowing the transfer belt to newly carry or bear the paper by static electricity. Thus, after the charges for allowing the paper to adhere to the transfer belt 4 and holding the same thereon and the charges applied when the toner image is transferred to the paper have been removed, a cleaning process is performed by the cleaning device so that the function or action for holding another paper on the transfer belt anew can be satisfactorily performed. Further, a paper peeling or separating means and a means for driving and guiding the transfer belt 4 are provided at the other end of the transfer belt 4. An end of the portion for conveying the paper by the transfer belt is supported by the roller member 22 and a separation claw member 26 for peeling or separating the paper is provided at the position where the transfer belt 4 is abruptly bent by the roller member 22.

In the paper feeder according to the present invention, a sensor Sa is provided in the paper feeding path extending from the paper feeding trays 11*a*, 11*b*, . . . , a sensor Sb is provided close to the downstream side of the paper adhering portion of the transfer belt 4 and a sensor Sc is provided downstream of a paper separation portion of the transfer belt 4. Further, a sensor S9 is provided downstream of the fixing device 5 so as to form a means for detecting a paper jam developed in the paper conveying path. Individual pieces of information detected by the sensors are inputted to a control unit of a main body of the image forming apparatus. When the paper jam takes place, such information can be used as data for driving the transfer belt or the like to forcedly eject paper disposed upstream of the jammed paper.

A polyethylene terephthalate (PET) sheet, a polyvinylidene fluoride resin film or the like, for example, is used as the transfer belt 4 employed in the image forming apparatus and is available as a conveying sheet made of a dielectric. Further, materials having high insulating properties, such as a polyester film, a polycarbonate film, a polyether ketone film, etc., can be used for the transfer belt 4. After the film member has been cut to predetermined dimensions, both ends thereof are joined together and are subjected to ultrasonic welding. The so-processed film member is used for the paper feeding means as an endless belt. In the present invention, a polyethylene terephthalate film having a thickness ranging from 50 μm to 200 μm and a volume resistivity ranging from $10^{10}$ to $10^{18}$ can be used as the transfer belt 4. In practice, a polyethylene terephthalate film having a thickness of 75 μm can be singly used as the transfer belt 4.

The transfer corotrons serving as corona chargers are disposed in the image transfer unit comprising the photosensitive drums so as to correspond to a sheet of paper supported by the transfer belt 4. Each of the transfer corotrons is set to a voltage ranging from +4.2 kV to +12 kV and a current ranging from +50 μA to +2000 μA so that a transfer current is applied thereto. As shown in FIG. 2, the separation claw member 26 made of a resin material and the destaticizing corotron 45 for effecting a destaticizing operation on the paper and the transfer belt are provided at the position where the paper is separated or peeled from the transfer belt 4. The destaticizing corotron 45 is comprising an a.c. charger to which a d.c. bias at the time of generation of alternating current can be applied.

Figure 3:
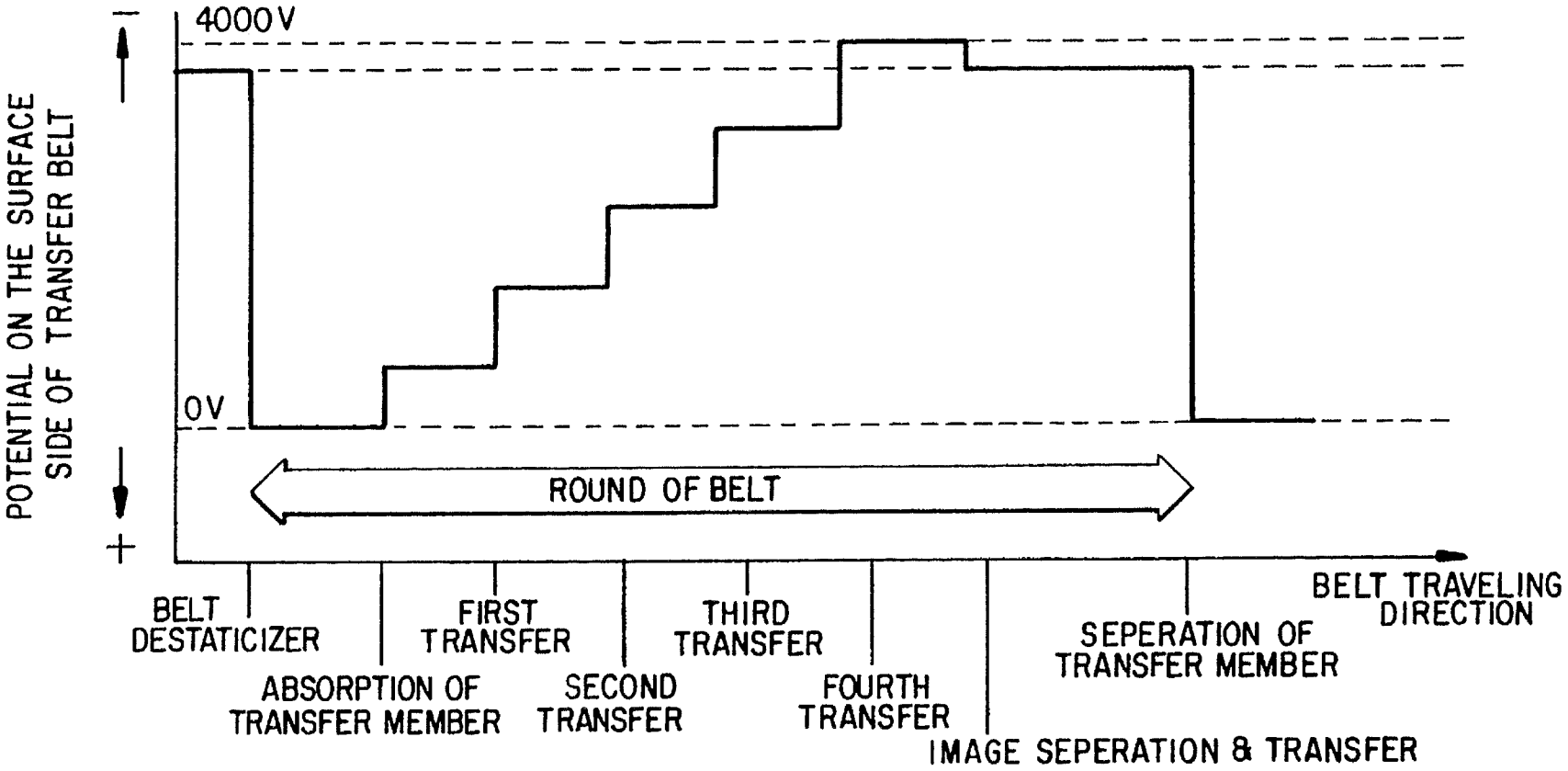
FIG. 3 is a graph showing the state in which the transfer belt is being charged.

In a state in which, as shown in FIG. 2, the plurality of photosensitive drums 3, 3*a*, . . . have been provided along the paper conveying path and the transfer corotrons 30, 31, . . . have been provided to transfer the images from the photosensitive drums to the corresponding paper, the state of charging of the transfer belt 4 is set as indicated by a graph in FIG. 3. In the graph illustrated in FIG. 3, the potential on the surface of the transfer belt 4 is brought to zero by destaticizing the transfer belt 4 with the pair of destaticizing corotrons 37 at a stage prior to the adhering of the paper to the transfer belt and the holding of the paper thereon. Thereafter, the action of charging of the charging corotron 35 on the transfer belt 4 is effected to allow the paper to adhere to the transfer belt 4 and the four transfer corotrons 30 through 33 for transferring the images from the corresponding photosensitive drums are repeatedly discharged. As a result, the potential on the surface of the transfer belt 4 is raised up to −4000 V or so. When a paper separation corotron 36 effects discharging on the transfer belt 4 at the paper separating position, the surface potential is slightly reduced. However, the amount of reduction in the potential is brought to a relatively low value. Further, an operation for peeling or separating the paper by the paper separation portion is performed in a state in which the action for allowing the paper to adhere to the transfer belt 4 and holding the same thereon by static electricity of very large values is being applied to the transfer belt 4.

When the paper supported by the transfer belt 4 is peeled from the transfer belt 4 at the position of the roller member 22, the action for spontaneously peeling or separating the leading end portion of the paper from the transfer belt by the nerve of the paper using the diameter (curvature) of the roller member is used as well as the action for reducing the potential on the surface of the transfer belt 4 by the discharging of the separation corotron 36. In addition to the action of peeling the paper from the transfer belt 4 in a spontaneous state, the action for forcedly separating the paper by the separation claw member 26 is performed. However, there is a case in which the paper cannot be normally peeled from the transfer belt 4 under the action of conditions such as the percentage of moisture content of the paper, a subtle curling (or abnormal rolling of the paper) of the leading end portion of the paper, or the state of discharging of each of the charging corotron 35 and the separation corotron 36. When the separation-miss paper appears as described above, it is detected by a separation-miss sensor Sc provided downstream of the paper separation portion and the detected information is outputted to the control unit. Further, in the paper feeder according to the present invention, the sensor S9 is provided even downstream of the fixing device 5 so as to serve as a means for detecting jamming of each paper ejected from the fixing device.

[Operations corresponding to jam detection]

When it is desired to continuously feed A4-size paper in the cross direction, for example, in the paper feeder employed in the image forming apparatus of the present invention, which is constructed as described above, two sheets of paper, a sheet of paper, a sheet of paper and two sheets of paper (four sheets of paper in practice) are respectively fed to the conveying regions 12 and 13, the paper feeding path 14, the position of the fixing device and the transfer belt 4. When paper jams occur in the paper feeder in a state in which the sheets of paper are being fed under the above condition, the following processes can be performed in association with the positions where the paper jams took place.

(a) When a paper jam occurs in the paper feeding portion extending from the paper feeding tray 11

When the paper jam is developed in the paper feeding portion extending from the paper feeding tray, a sheet of paper in the course of being fed within the paper conveying path presents no problem. Therefore, an operation for making a copy in the corresponding mode is continuously effected on a sheet of paper while being in the course of formation of an image. Namely, an image forming process is continuously effected on the paper carried by the transfer belt 4, the paper held by the fixing device 5 and the paper while being in the course of its ejection as it is, and a process of ejecting the paper as normal copies is executed. On the other hand, when a sheet of paper existing between the upstream side of the transfer belt 4 and the paper feeding trays, the paper is forcedly ejected as a miss copy in blank paper to thereby clear all the paper from the paper conveying path on the downstream side of the corresponding paper feeding tray. Thereafter, the paper feeder is deactivated so as to offer a representation of the paper feeding tray at the position where the paper jam occurs, to an operator. Thereafter, the paper feeder instructs the operator to pull out the corresponding paper feeding tray and perform paper jam processing.

(b) When a paper jam is developed around the fixing device

Since a sheet of paper in the paper conveying path on the upstream side of the jammed paper cannot be forcedly ejected in this case, the operation of the paper feeder is immediately stopped after detection of its jamming and the paper feeder instructs the operator to remove the paper that exists in the fixing device. Next, the operator pulls an integrated unit of the transfer belt and the fixing device out of the body of the paper feeder and removes the jammed paper from the fixing device so as to mount the unit to the original position, followed by operation of an interlock switch of the paper feeder. The control unit of the image forming apparatus sets a mode for forcedly ejecting the paper left in the paper conveying path, based on the information about the interlock switch and starts a paper ejecting operation. Upon execution of the mode, the paper fixed by the fixing device in a state in which the toner image already transferred from the corresponding photosensitive drum is carried by the paper disposed in the position of the transfer belt, is ejected and processed as a miss copy. Further, the paper located in the paper conveying path on the upstream side of the transfer belt is ejected in blank paper.

(c) When a paper jam occurs in the position of the transfer belt

It cannot be judged in this case whether or not the jammed paper is stopping moving at a region where the jammed paper is absorbed by the transfer belt or at the image transfer unit. Therefore, the paper feeder is deactivated at once to instruct the operator to pull out the unit of the transfer belt from the main body thereof and remove the jammed paper.

As described in the paragraphs a through c, the jammed-paper processing operation can be effected on the typical paper jam developed in the paper conveying path. However, the same paper-jam processing as described above can be performed even when the paper jam takes place at the other region. A sheet of paper on which an image can be transferred by an image forming unit, is subjected to an image transfer process similar to that performed when a normal copy is made, and is fixed by the fixing device, after which the copy is ejected from the present device. By at least allowing the transfer belt to electrostatically bear or carry a sheet of paper to be forcedly ejected in the blank paper or in a state in which an incomplete image has been transferred on the paper and allowing the transfer belt to separate the paper therefrom while the operations of discharge of the charging corotron 35 and the separation corotron 36 into the transfer belt are continuously carried out, the paper can be prevented from being fed unstably in the region to which the paper is conveyed by the transfer belt.

[When the paper is fed while being carried by the transfer belt]

Now, consider where the action for carrying the paper by the discharge of the charging corotron is effected on the transfer belt when the paper is forcedly ejected from the paper feeder as described above. In the paper feeder shown in FIG. 2, a voltage having the same polarity as that of a transfer discharge current is applied to the charging corotron 35 upon normal copying. However, a current supplied from the charging corotron 35 is set so as to be identical to or below a current supplied from the transfer corotron 30 immediately after its supply. Assuming that an effective current produced from the charging corotron 35 is +12 μA and effective transfer currents produced from the transfer corotrons 30 through 33 are respectively +17.5 μA, the potential on the surface of the transfer belt is actually brought to −800 V or so as indicated by the graph in FIG. 3 in a state in which the paper is being absorbed by the transfer belt. If the separation corotron 36 is discharged at an end of the transfer belt on the ejection side where the transfer corotrons in the respective image transfer units are deactivated in the forced ejection mode, then the surface potential of the transfer belt is finally brought to about −1200 V.

When an operation for transferring images from the photosensitive drums to the corresponding paper to thereby make a normal copy is performed in contrast to the aforementioned transfer-belt charging system, the discharges of the transfer corotrons 30 through 33 corresponding to the photosensitive drums are effected on the transfer belt. As indicated by the graph in FIG. 3, a phenomenon is developed in which the potential on the surface of the transfer belt is stepwise increased owing to the discharges of the transfer corotrons and the transfer belt is finally charged to −4000 V or so.

Thus, when the forced ejection mode is set and the charging corotron 35 and the transfer corotrons 30 through 33 are activated in the paper feeder of the present invention using the transfer belt, it is necessary to activate the destaticizing corotrons 37 for destaticizing the transfer belt simultaneously with these corotrons in the same manner as when the normal image forming operation is performed and to remove a residual potential. If the residual potential of the transfer belt is taken as −4000 V, for example, where the operation for destaticizing the transfer belt is performed by the destaticizing corotrons 37, then both a voltage ranging from +2.5 kV to +4.5 kV and an alternating current having a frequency ranging from 400 Hz to 1000 Hz can be adjusted as necessary and applied to the destaticizing corotrons 37 with a 180° phase difference held therebetween. After the transfer belt has passed through the discharge position of the destaticizing corotrons 37, the surface potential of the transfer belt can be controlled to within +2000 V. Incidentally, a means for superimposing d.c. components on each other as well as the a.c. components and applying the same may be employed in the destaticizing corotron.

On the other hand, when the paper is ejected as a miss copy in the form of white paper under the forced ejection mode, the paper passes through the transfer region corresponding to each photosensitive drum and is ejected. At this time, the charging corotron 35 is discharged to allow the transfer belt to absorb and hold the paper. Further, the transfer corotrons 30 through 33 are discharged as necessary so as to perform a paper conveying operation while the paper is being prevented from being wound around the corresponding photosensitive drum. When the paper is fed by the transfer belt, minus or negative charges induced to the paper are concentrated on a rear end of the paper in particular to thereby produce discharge breakdown of air at the instant of separating the rear end thereof from the corresponding photosensitive drum. Thereafter, plus ions of the charges are attracted into the corresponding photosensitive drum and remain on the surface of the photosensitive drum as plus electrical memories. The memories left on the photosensitive drum are irradiated with light emitted from a light source for destaticizing the photosensitive drum and have characteristics that they do not disappear even if passed through the discharge region of the charging corotron. Potentially, the residual memories slightly become lower than a background potential. Thus, in the case of a process of a reverse development system, the charges left on the surface of the photosensitive drum are developed as stripes and are printed out upon next copying. This phenomenon is noticeably developed in particular when the destaticizing corotron is not allowed to act on the photosensitive drum under the paper forced ejection mode.

In order to avoid such inconvenience, it is effective to activate the charging corotron and the pair of destaticizing corotrons provided so as to correspond to the photosensitive drum upon setting of the forced ejection mode in the same manner as when the toner images are normally formed. By activating the two corotrons disposed so as to correspond to the photosensitive drum, the normal background potential is applied to the photosensitive drum by the discharge of the charging corotron and a potential having polarity identical to that of the charging corotron is applied to the destaticizing corotron pair. Thus, when the rear end of the paper is separated from the photosensitive drum, the plus electrical memories can be canceled out by the above-described charging action.

Further, when the discharge of the charging corotron is effected on the photosensitive drum, a device in which a two-component developer is used in a developer unit, needs to take a means for applying bias to all the development rollers of a developer unit and preventing carriers of the two-component developer from adhering to the photosensitive drum. It is most desirable that, in the process device corresponding to each photosensitive drum, all the components excluding a motor of the developer unit are activated in the same manner as upon normal image formation even if the paper is forcedly discharged as described above and the paper is ejected in the blank paper.

Figure 4:
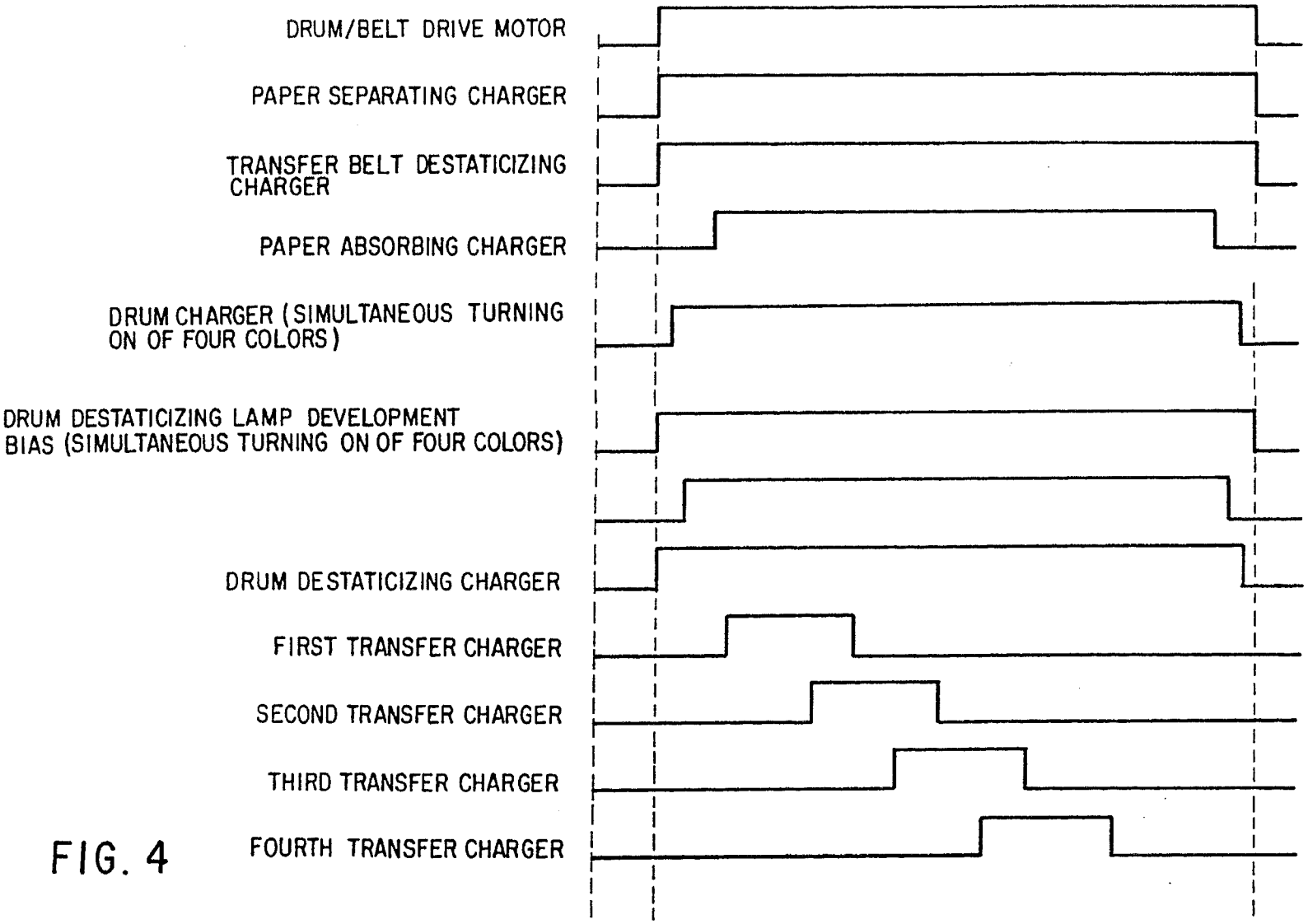
FIG. 4 is a timing chart for describing operations of respective devices at the time of processing of a paper jam.

When the paper is forcedly ejected as described above, control indicated by a timing chart in FIG. 4 is effected on respective actuating members. When the mode for forcedly ejecting the paper is set in accordance with the timing chart of FIG. 4, a drive motor used for each of the photosensitive drums and the transfer belt is turned on. On the other hand, when the forced ejection mode is completed, the drive motor is turned off. The paper separation corotron 36 and the transfer-belt destaticizing corotron pair 37 are turned on and off in synchronism with the above operation. Further, the charging corotron 35 for charging the transfer belt is turned on in unison with the time to allow the position of the destaticized transfer belt to reach the charging corotron 35, in timing at which the charging corotron 35 is slightly delayed in operation from the destaticizing corotron pair 37. After the final paper at the time of the forced ejection mode has been ejected from the transfer belt, the charging corotron 35 is turned off prior to the turning off of other image forming means.

Aside from the corotrons disposed so as to correspond to the transfer belt, each charging corotron 40 disposed relative to the photosensitive drum is activated with a small delay developed from the time to start operating the photosensitive drum and the transfer belt and is turned off before the completion of rotation of the photosensitive drum. Further, each destaticizing lamp 44 provided so as to correspond to the photosensitive drum is turned on and off in synchronism with the rotation of the photosensitive drum, whereas a developing bias of each developer unit 42 is brought into an on state with a slight delay developed from the rotation of the photosensitive drum and is brought into an off state prior to the completion of its rotation. The photosensitive drum is rotated but the writing means is deactivated. Thus, the image forming operation is not performed even if the photosensitive drum is charged, thereby causing no transfer of the toner and the carriers from the developer unit to the paper. Further, the transfer corotrons 30 through 33 provided so as to correspond to the photosensitive drums successively perform discharge operations for predetermined time intervals alone in unison with the timing of movement of the paper.

When the mode for forcedly ejecting the paper is established as described above, the discharging means and the like provided relative to the transfer belt and the photosensitive drums are activated as indicated by the timing chart shown in FIG. 4. It is thus possible to prevent a separation and discharge phenomenon from being developed in a state in which the paper is separated from the photosensitive drum. Owing to the actuation of the respective discharging means, electrical memories developed due to their discharge can be prevented from being left on the surface of the photosensitive drum. Further, each developer unit using the two-component toner can prevent the carriers of the developers from adhering to the photosensitive drum.

[Embodiment of an image forming apparatus using a photosensitive body]

The embodiment according to the present invention describes the case where the processing of the paper jam developed in the paper conveying path is performed in the color electrophotographic copier wherein the plurality of photosensitive drums are provided along the paper conveying means formed by the transfer belt and the color toner images are transferred to the paper in a superimposed state. The operation for processing the paper jam, according to the present invention can be applied to an image forming apparatus shown in FIG. 5. The embodiment illustrated in FIG. 5 forms the image forming apparatus in which only a single photosensitive drum 3 is provided so as to form a monochrome image. Process members 40 through 45 and the like similar to those shown in FIG. 2 are provided so as to correspond to the photosensitive drum 3. Further, a charging corotron 35 and a press roller 25, a separation corotron 36 and a destaticizing corotron 37 are respectively provided at a paper absorbing position, a paper separating position and a belt return position so as to correspond to a transfer belt 4 for conveying a piece of paper.

In a state in which each of sheets of paper, which are fed out from paper feeding trays 11*a*, 11*b*, . . . disposed in a paper feeding unit, is being held by the transfer belt 4 through a paper feeding path 14, a toner image on the photosensitive drum 3 is transferred to the paper under the action of discharge of a transfer corotron 30. After the toner image has been transferred to the paper, the paper is separated from the transfer belt and is fixed by a fixing device 5. Next, the paper completed as a copy is fed toward an ejection tray. When the paper jam is developed in the paper feeding path, a paper ejecting process can be performed so as to correspond to the position of generation of the paper jam.

Figure 5:
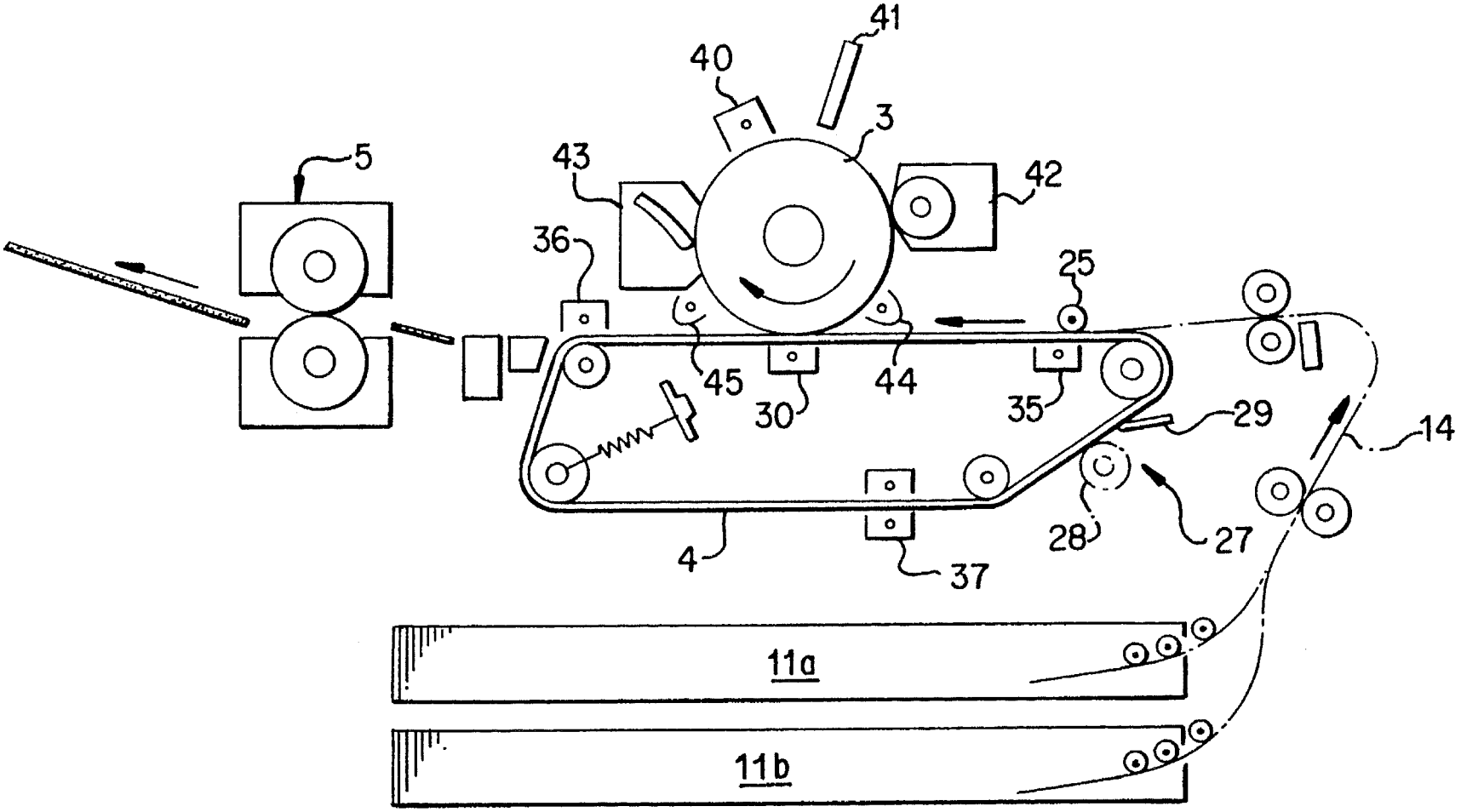
FIG. 5 is a view for explaining an image forming apparatus using a single photosensitive drum.

When the paper jam takes place in the image forming apparatus shown in FIG. 5, e.g., a paper feeding unit extending from a corresponding paper feeding tray, a sheet of paper in the course of being fed within the paper conveying path has no problem. Therefore, a process for making a copy of paper while being in the course of formation of an image thereon is continuously performed in the original mode. When a paper jam is developed around the fixing device, a sheet of paper that exists in the paper conveying path on the upstream side of the jammed paper, cannot be forcedly ejected. Therefore, the image forming apparatus is immediately deactivated after detection of the paper jam so as to instruct an operator to remove the paper existing in the fixing device therefrom. Next, the operator pulls out an integrated unit of the transfer belt and the fixing device from a main body of the image forming apparatus and removes the jammed paper from the fixing device. Thereafter, a mode for forcedly ejecting the paper left in the paper conveying path is set so as to start the paper ejecting operation.

Further, when a paper jam is developed in the position of the transfer belt, it cannot be judged whether or not the jammed paper is stopping moving at a region where the jammed paper is absorbed by the transfer belt or at an image transfer unit. Therefore, the image forming apparatus itself is immediately deactivated to give to the operator a command for pulling out a unit of the transfer belt from the main body thereof and removing the jammed paper therefrom. Jam postprocessing can be performed by executing the process of forcedly ejecting the paper existing in the paper conveying path in accordance with the aforementioned automatic ejection mode. When the paper forcedly ejecting operation is carried out in addition to the above operation, the action of charging and destaticizing on the transfer belt and the action of charging and destaticizing on the photosensitive drum are performed in the same manner as when the plurality of photosensitive drums are used. The image forming apparatus according to the present invention can prevent an influence exerted on the photosensitive drum by discharge or the like when the paper is forcedly ejected. Further, the image forming apparatus makes it possible to satisfactorily perform the paper conveying and ejecting operations.

Since the image forming apparatus according to the present invention has the aforementioned construction, the action for forcedly ejecting the paper can be performed while the action for causing the transfer belt to absorb and hold the paper and the like are being continuously executed where the paper jam is developed in each of the conveying paths of the transfer belt and the paper conveying path provided before and after the conveying path. When the mode for forcedly ejecting the paper is used, the means for allowing the paper to electrostatically adhere to the transfer belt and the means for continuing the discharge of the separation corotron serving as the means for peeling or separating the paper and preventing the paper from electrostatically adhering to the photosensitive drum can be activated. It is possible to prevent the paper from being wound around the photosensitive drum or the like and separated from the transfer belt in the course of feeding the paper by the transfer belt. It is thus possible to perform the operation for feeding the paper by the transfer belt and forcedly ejecting the paper. Further, the paper jam can be prevented from being developed anew in the course of the operation for forcedly ejecting the jammed paper.

According to the image forming apparatus of the present invention, when the forced ejecting operation is performed, the mode for ejecting the paper left in the paper conveying path while the corotron and the like are being activated and the mode for ejecting the paper without discharge or the like can be suitably selected according to information about the position of generation of the paper jam. When the paper is ejected from the paper conveying path, the paper ejecting process can be carried out while preventing the paper from being wound around the corresponding photosensitive drum. By forcedly ejecting the paper left in the paper conveying path and delivering the ejected paper to a purge tray or the like, the operator can easily perform the postprocessing. When it is able to normally continue copy producing work depending on the position of the paper jam, discharge memories can be prevented from being left on the corresponding photosensitive drum upon execution of the forced ejecting operation and the subsequent copy can be prevented from being smudged. After the paper jam has been processed, the operation for making the normal copy can be immediately resumed.

Having now fully described the invention, it will be apparent to those skilled in the art that many changes and modifications can be made without departing from the spirit or scope of the invention as set forth herein.

What is claimed is:

1. A jam processing device suitable for use in an image forming apparatus, said image forming apparatus comprising: at least one image carrier disposed adjacent to means for electrostatically carrying the recording paper; said recording paper carrying means forming part of a paper conveying path; means for acting on said at least one image carrier, said recording paper and said recording paper carrying means; said image carrier acting means comprising a charging device and a developer, said jam processing device comprising:

detecting means for detecting paper jams at a plurality of locations along said paper conveying path;

control means for forcedly ejecting any recording paper existing in said paper conveying path in accordance with information about a paper jam detected by said detecting means; and means for selectively controlling actuation of said means acting on said at least one image carrier based on the information about the paper jam detected by said detecting means when the recording paper is forcedly ejected from said paper conveying path, wherein when said at least one image carrier means is deactuated, said charging device is in an operating state and said developer is in a non-operating state.

2. The jam processing device as claimed in claim 1, wherein said means acting on said recording paper carrying means comprises charging and destaticizing means, and when it is determined, based on said information, that the image forming apparatus cannot continue to normally form images on the recording paper left within said paper conveying path upon forcedly ejecting the recording paper, said control means actuate the charging and destaticizing means.

3. The jam processing device as claimed in claim 1, wherein when it is determined, based on said information, that the image forming apparatus is able to continue to normally form images on the recording paper left within said paper conveying path upon forcedly ejecting the recording paper, an operation for ejecting the recording paper is allowed to continue while a normal image-forming operation remains continued and control for preventing the feeding of new recording paper to said paper conveying path is performed.

* * * * *